United States Patent [19]

Van Orsdel

[11] Patent Number: 4,501,502

[45] Date of Patent: Feb. 26, 1985

[54] APPARATUS AND METHOD FOR TIMEKEEPING AND TIME CORRECTION FOR ANALOG TIMEPIECE

[76] Inventor: James Van Orsdel, 1917 Commonwealth Ave., Charlotte, N.C. 28205

[21] Appl. No.: 515,806

[22] Filed: Jul. 21, 1983

[51] Int. Cl.[3] ..... G04C 11/02; G04B 19/04

[52] U.S. Cl. ..... 368/47; 368/80

[58] Field of Search ..... 368/46–47, 368/49–52, 59–62; 375/106–109; 455/12

[56] References Cited

U.S. PATENT DOCUMENTS

| | | | |
|---|---|---|---|
| 490,698 | 1/1893 | Weston | 368/56 |
| 1,997,979 | 4/1935 | Smith | 368/47 |
| 3,188,792 | 6/1965 | Dupuy | 368/52 |
| 3,213,602 | 10/1965 | Pfeffer et al. | 368/47 |
| 3,472,019 | 10/1969 | Webb | 368/47 |
| 4,014,166 | 3/1977 | Cateora et al. | 368/47 |
| 4,287,597 | 9/1981 | Paynter et al. | 455/12 |

*Primary Examiner*—Vit W. Miska

*Attorney, Agent, or Firm*—W. Thad Adams, III

[57] ABSTRACT

A time synchronizer is disclosed for an analog timepiece. An electronic circuit 20 is disclosed which generates a direct current pulse upon receipt of an input signal from a remote source. Circuit 20 is operable in two separate modes through outputs from a timekeeping output 25 and a time correction output 38. The time correction mode operates through a feather switch 35 having a contact 35*b* which rides in a cam 34 of a rotating wheel 33 which moves in synchronization with hands 12A and 12B of an analog timepiece.

10 Claims, 6 Drawing Figures

APPARATUS AND METHOD FOR TIMEKEEPING AND TIME CORRECTION FOR ANALOG TIMEPIECE

TECHNICAL FIELD AND BACKGROUND OF THE INVENTION

This invention relates to a time synchronizer for an analog timepiece. Technology in this area includes means by which a time signal is derived and generated from a master timepiece at periodic intervals and is transmitted to a slave timepiece whereby a correction of the time of the slave timepiece takes place. Much of the recent work in this area has involved generation and display of very accurate time by means of purely electronic timepieces. However, there are still many applications which lend themselves to use of a conventional analog timepiece, including those driven by mechanical gear sets. Many known electronic circuits for the detection and correction of time errors are not suitable for use with an analog timepiece since sufficient energy must be provided to electromechanically move the hands of the timepiece. Examples of technology directed to time synchronization in electronic timepieces are U.S. Pat. No. 4,287,597; U.S. Pat. No. 3,472,019 and U.S. Pat. No. 4,175,376.

In many known master/slave timekeeping devices actual time is kept by the slave, subject to correction at predetermined intervals by a synchronization signal transmitted to the slave timepiece from the master timepiece. In accordance with the present invention, a timekeeping signal is transmitted by a time source to an analog timepiece and activates electromechanical means for moving the hands of an analog timepiece. At a predetermined periodic time interval a separate time correction signal is transmitted from the time source to the analog timepiece for correcting its time and putting it back into synchronization with the time source.

SUMMARY OF THE INVENTION

Therefore, it is an object of the invention to provide a time synchronizer for an analog timepiece.

It is another object of the present invention to provide a time synchronizer for an analog timepiece wherein a wireless electromagnetic signal is transmitted to the analog timepiece by a geosynchronous earth satellite.

It is yet another object of the present invention to provide a time synchronizer for an analog timepiece which includes a time source which transmits a timekeeping signal at a predetermined interval and separate time correction signal at a predetermined interval which permits the analog timepiece to be corrected for an accumulated time error between it and the time source.

BRIEF DESCRIPTION OF THE DRAWINGS

Some of the objects of the invention have been set forth above. Other objects and advantages of the invention will appear as the description of the invention proceeds, when taken in conjunction with the following drawings, in which.

DESCRIPTION OF THE PREFERRED EMBODIMENT

Figure 1:
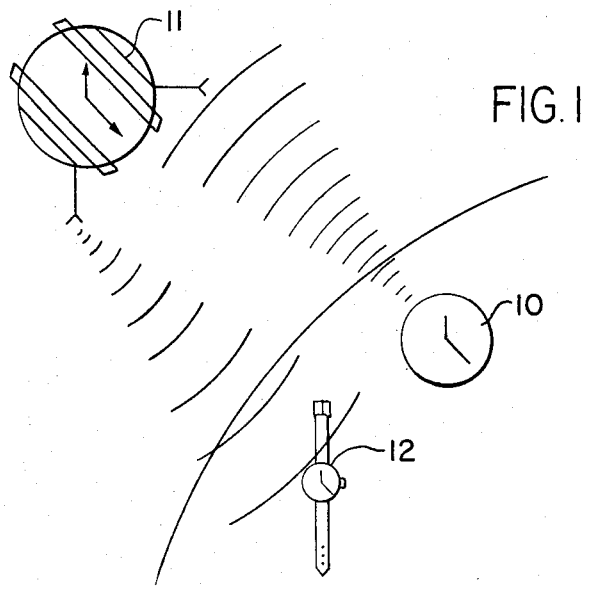
FIG. 1 is a schematic view illustrating one embodiment of the invention wherein a time signal is transmitted from a master time source to a geosynchronous earth satellite from which a time signal is returned to Earth for reception by a slave analog timepiece.

Referring now specifically to the drawings, one embodiment of the present invention is shown generally in FIG. 1. In accordance with this embodiment, a time source in the form of a master clock 10 transmits a suitably coded signal to a geosynchronous earth satellite 11 which, in turn, transmits a coded time signal back to earth for reception by any suitable receiver which is within the transmission reception zone of the satellite. In FIG. 1 a wristwatch 12 is shown in signal receiving position. However, an analog timepiece of any size or suitable construction may be used.

Figure 2:
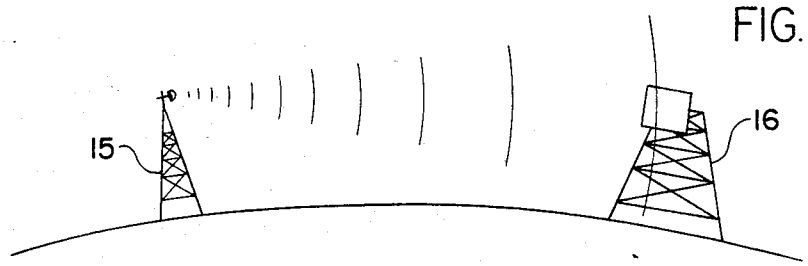
FIG. 2 is another embodiment of the present invention wherein a time signal is sent from an earth transmitter directly to an earth receiver.

In FIG. 2, another embodiment of the present invention is shown and comprises a transmitter 15 which sends a coded time signal to a receiver 16 located at some predetermined, remote location. The time signal may be received directly from the transmitter 15 or may be retransmitted by the receiver 16 by landline or by repeater (not shown).

Figure 3:
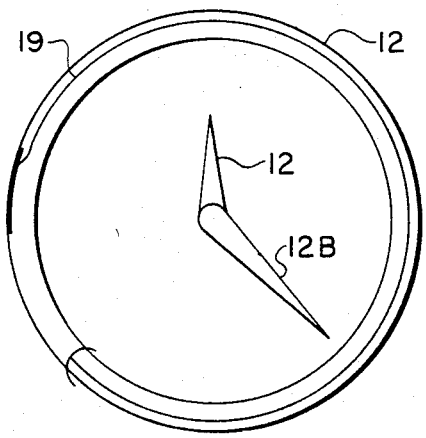
FIG. 3 is a schematic, partially enlarged view of the wristwatch shown in FIG. 1, illustrating the presence of a thin wire antenna extending around the circumference of the watch.

FIG. 3 shows an enlarged view of the timepiece in the form of a wristwatch 12 shown in FIG. 1. As can be seen in FIG. 3, wristwatch 12 includes an antenna 19 which extends around the major portion of the periphery of wristwatch 12, and may, for example, be embedded within the crystal. Of course, since the timepiece shown is an analog one, it includes hands 12A and 12B which indicate the time.

Figure 4:
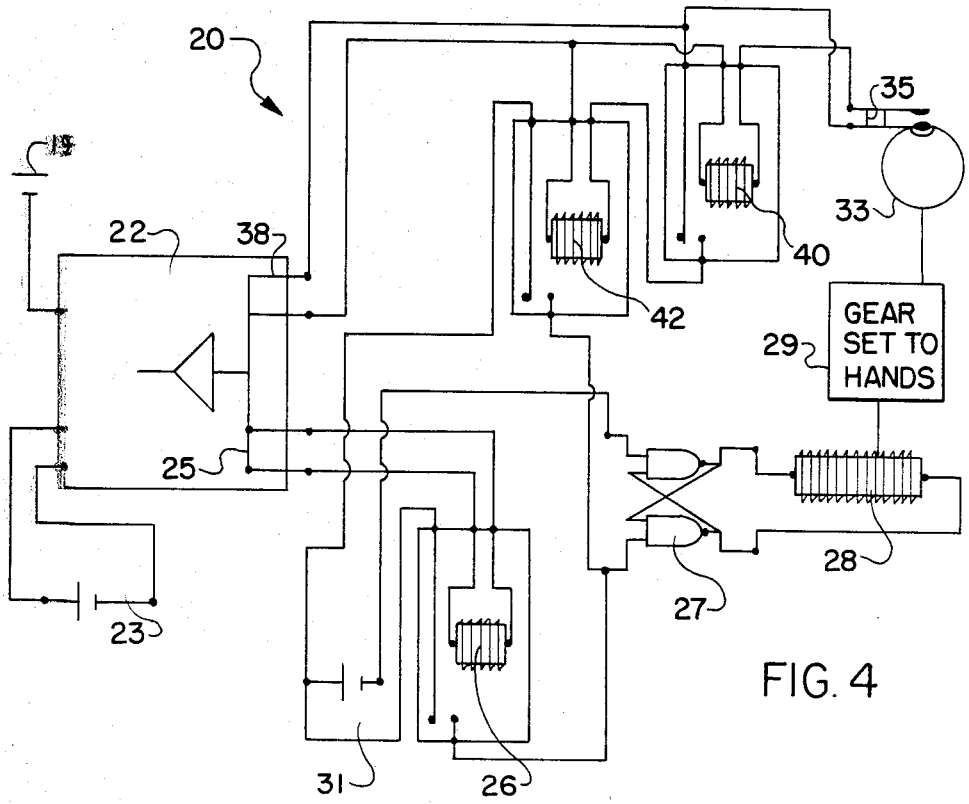
FIG. 4 is a circuit diagram of a receiver, timekeeping circuit and time correction circuit according to the present invention.

Referring now to FIG. 4, a timekeeping and correction circuit according to the present invention is shown in electrical schematic notation. Since the circuit is shown schematically, it is not drawn to scale. Moreover, in an actual embodiment the circuit would preferably be in the form of an integrated, solid state device which would be so small as to very easily fit within a wristwatch.

The normal timekeeping mode operates through suitable coded signals received at antenna 19. A receiver 22 of conventional design decodes and amplifies the signal which it receives and converts it into a direct current (DC) pulse. Amplifier 22 is provided with its own DC power supply 23 which may be a small battery, as is indicated in FIG. 4, or a DC converter operating off of AC current for larger, stationary timepieces. The DC pulse generated by receiver/amplifier 22 is driven to a timekeeping mode output 25 and through suitable conductive means to a micro-relay switch 26. Activation of switch 26 feeds the DC pulse to a known set-reset, flip-flop circuit 27 which activates a step motor 28. Step motor is mechanically connected to a conventional watch gear set 29 which moves the hands of the watch. Pulses may be received every second, every ten seconds, every minute or any other suitable time interval. Given the fact that this system is an electromechanical one, the interval must be sufficient to permit the mechanical activation and deactivation of the step motor 28 and gear set 29 during each pulse.

The flip-flop circuit 27 is a type of bi-stable multivibrator circuit that has two imputs corresponding to the two stable states. The circuit contains two linear inverters coupled in such a way that the output of one provides the imput for the other.

A separate DC power source 31 is provided for step motor 28. Since circuit 20 has separate power sources 23 and 31, one may be of an optimal type to provide continual power in the case of the amplifier 22, and the other to provide pulses of power in the case of step motor 28. Of course, when a single power source is adequate the circuit may be simplified accordingly.

Some minimal delay is expected in the activation and completion of the movement of the hands by gear set 29. Therefore, the timepiece 12 is set ahead slightly so that at the completion of each pulse and hand movement, the correct time is displayed. Since the time source is completely external to timepiece 12, there is no real need to provide a high degree of internal mechanical accuracy to timepiece 12. Rather, the important criterion is the accuracy of the time source 10. Since the time signal is received and processed instantaneously, a highly accurate electromechanical timepiece is possible.

Furthermore, in many instances accuracy to an absolute time standard is less important than proper synchronization of a number of timepieces. This invention serves this function reliably and inexpensively.

Figure 5:
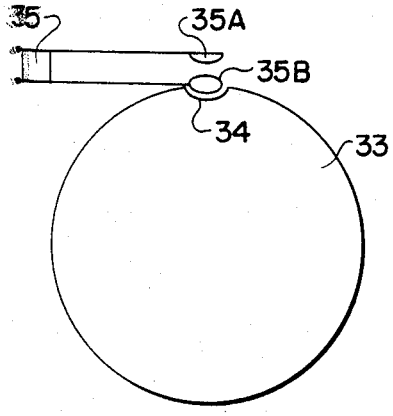
FIG. 5 is a fragmentary, enlarged view of the synchronization cam of the time correction circuit shown in FIG. 4 with the cam in synchronized position.
Figure 6:
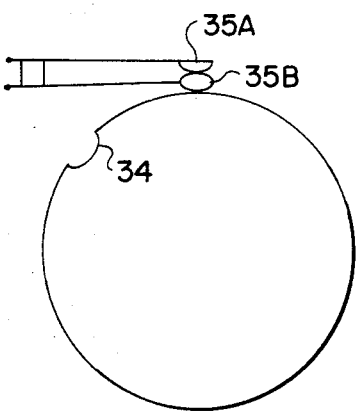
FIG. 6 is a view similar to FIG. 5 but showing the synchronization cam in unsynchronized position.

In instances where even greater accuracy is required, automatic synchronization of timepiece 12 to the clock 10 can be easily provided. In general, the synchronization circuit is provided with a separate signal to "test" the timepiece 12 to see if it is still in synchronization with time source 10. The separate synchronization signal is transmitted, for example from satellite 11, at a relatively long time interval such as once each hour or once each day. Synchronization itself takes place by mechanical movement of hands 12A and 12B. This is accomplished by means of a wheel 33 which is mounted within watch 12 for synchronized rotation with hands 12A and 12B. As is best shown in FIG. 5, wheel 33 is provided with an indented cam surface 34 on its circumferential periphery. Since wheel 33 rotates in synchronization with the hands, the cam 34 must be in a particular position relative to hands 12A and 12B. Wheel 33 and cam 34 cooperate with a feather switch 35 which has two aligned switch contacts 35A and 35B which are normally biased apart. Still referring to FIG. 5, when wheel 33 is in its proper position indicating that timepiece 12 is properly synchronized with time source 10, contacts 35A and 35B are spaced apart from each other, thereby interrupting an electrical circuit which will be described below. Referring now to FIG. 6, wheel 33 is shown in a position indicating that timepiece 12 is not in synchronization with time source 10. As a result, probe 35B is not positioned in cam 34 but has ridden up onto the peripheral surface of wheel 33 and into contact with contact 35A. The circuit is closed, and the following synchronization process takes place.

The synchronization signal is received at antenna 19 and directed to receiver/amplifier 22. The signal is amplified and converted into a DC pulse having characteristics different from the timekeeping DC pulse. A time correction output 38 is provided and is tailored to the characteristics of this DC signal so that the signal is conveyed from output 38 to the feather switch 35. If, as is shown in FIGS. 4 and 5, wheel 33 is in its proper position indicating that timepiece 12 is synchronized with time source 10, the circuit is interrupted and since no synchronization is necessary, no synchronization takes place. If, however, wheel 33 indicates that timepiece 12 is not synchronized with time source 10, feather switch 35 is closed, as is shown in FIG. 6. In this case, the DC pulse is carried through feather switch 35 to a first micro-switch 40. Switch 40 in turn activates another micro-switch 42 which is connected into the time keeping circuit previously described. The DC pulse is conveyed through micro-switches 40 and 42 to flip-flop circuit 27 which activates step motor 28.

Step motor 28 activates gear set 29 which drives hands 12A and 12B. Since wheel 33 is connected to hands 12A and 12B it rotates as well. When the hands reach the point of synchronization with the time source 10, contact 35B drops into cam 34 breaking the circuit, and stopping step motor 28. Of course, a magnetic proximity or other suitable switch could be utilized instead of feather switch 35 shown above.

Even though the disclosure of the invention contained in the application has emphasized a utility in small timepieces such as the wristwatch, the invention nevertheless has substantial applications in large timepieces such as wall, case or tower clocks. Stepping motors can be manufactured in all sizes to generate torque sufficient to operate virtually any size clock. In addition, remote activation of clocks by a master time source could also be utilised to activate alarm, chiming or striking mechanisms and to control automatic devices of many different types. In situations where large timepieces are contained in buildings or shielded from proper reception of a signal transmitter, an antenna lead can easily be installed in an exterior position with the lead carrying the signal by wire to the timepiece.

An apparatus and method for synchronizing an analog timepiece from a time source is described above. Various details of the invention may be changed without departing from its scope. Furthermore, the foregoing description of a preferred embodiment of the apparatus and method according to the present invention is provided for the purpose of illustration only and not for the purpose of limitation—the invention being defined by the claims.

I claim:

1. A time synchronizer for an analog timepiece, comprising:

(a) a time source;

(b) means for transmitting a wireless electromagnetic signal from the time source at a pre-determined periodic time interval;

(c) an analog timepiece;

(d) means carried by said analog timepiece for receiving said electromagnetic signal and processing said electromagnetic signal into signal pulse;

(e) motive means cooperating with the hands of the analog timepiece and with the means for receiving and processing said electromagnetic signal to move the hands of the timepiece to the position to display the time indicated by the time source; and (f) means for transmitting correction signal at a periodic interval, and wherein said means for receiving and processing said electromagnetic signal includes means for reviewing and processing said correction signal at given intervals in order to compensate for an accumulated time error between the time source and the analog timepiece.

2. A time synchronizer according to claim 1, wherein said means for transmitting a wireless electromagnetic signal comprises a geosynchronous earth satellite.

3. A time synchronizer according to claim 2, wherein said motive means comprises a step motor.

4. A time synchronizer for an analog timepiece, comprising:

(a) a time source;

(b) means for transmitting wireless electromagnetic signals from the time source at a predetermined periodic time interval, including a timekeeping signal and a time correction signal;

(c) an analog timepiece;

(d) means for receiving and processing said electromagnetic signals carried by said analog timepiece, and comprising;

(i) a timekeeping circuit for converting said timekeeping signal into an electromagnetic time indicating movement of the timepiece; and, (ii) a time correction circuit for converting said time correction signal into electromechanical time correcting movement of the timepiece.

5. A time synchronizer according to claim 4, wherein said timekeeping circuit comprises:

(a) a timekeeping signal receiving antenna;

(b) a timekeeping signal amplifier for amplifying said signal received by said antenna;

(c) a set-reset type flip-flop logic switch operatively controlling a step motor connected through a gear set to the hands of the timepiece; and, (d) a normally open switch relay positioned in series relation between said amplifier and said logic switch for closing upon receipt of a signal from said amplifier, thereby driving said gear set through said step motor.

6. A time synchronizer according to claim 4, wherein said correction circuit comprises:

(a) a correction receiving antenna;

(b) a correction signal amplifier for amplifying the time correction signal received by said antenna;

(c) a set-reset type flip-flop logic switch operatively controlling a step motor connected through a gear set to the hands of the timepiece;

(d) switch means intermediate said amplifier and said step motor, said switch means adapted to remain in an open position when the timepiece is correctly synchronized to the time source and in a closed position when the timepiece is not correctly synchronized to the time source, and wherein said switch means in its closed position actuates said step motor and moves the hands of said timepiece into synchronization with the time source and then opens, stopping the hands in the correct position.

7. A time synchronizer according to claim 6, wherein said switch means comprises:

(a) a wheel mounted for synchronized rotation with the hands of the timepiece, said wheel defining a cam surface around the circumferential periphery therof; and, (b) first and second contacts, one of which comprises a cam follower and the other of which is adapted to remain stationary and close or open the circuit as the cam follower is moved into and out of contact, respectively, therewith in response to rotation of the wheel.

8. A method for synchronizing an analog timepiece, comprising the steps of:

(a) transmitting a wireless electromagnetic signal from a time source at a pre-determined periodic time interval;

(b) providing an analog timepiece with means carried by said analog timepiece for receiving said electromagnetic signal and for processing said signal into a signal pulse;

(c) using said signal pulse for activating motive means cooperating with the hands of the analog timepiece to move the hands of the timepiece to the position to display the time indicated by the time source; and (d) transmitting a correction signal at a periodic interval and receiving and processing said correction signal at given intervals in order to compensate for an accumulated time error between the time source and the analog timepiece.

9. A method for synchronizing an analog timepiece according to claim 8, and in further including the steps of transmitting the wireless electromagnetic signal to a geosynchronous earth satellite; retransmitting the signal back to earth for reception by said analog timepiece.

10. A method of synchronizing time of an analog timepiece, comprising the steps of:

(a) transmitting a wireless electromagnetic timekeeping signal from a time source at a pre-determined time interval;

(b) transmitting a wireless electromagnetic time correction signal at a pre-determined time interval;

(c) providing an analog timepiece with means for receiving and processing electromagnetic signals into a signal pulse;

(d) converting said timekeeping signal pulse into an electromagnetic time-indicating movement of the hands of the timepiece; and, (e) converting said correction signal into electromechanical time correcting movement of the hands of the timepiece.

* * * * *